United States Patent [19]

Kimura et al.

[11] Patent Number: 4,613,226

[45] Date of Patent: Sep. 23, 1986

[54] DEVELOPING HEAD FOR ELECTROPHOTOGRAPHIC APPARATUS

[75] Inventors: Akinori Kimura; Shuichi Ohtsuka, both of Kanagawa, Japan

[73] Assignee: Fuji Photo Film Co., Ltd., Kanagawa, Japan

[21] Appl. No.: 564,493

[22] Filed: Dec. 22, 1983

[30] Foreign Application Priority Data

Dec. 23, 1982 [JP] Japan ..... 57-225047
Mar. 4, 1983 [JP] Japan ..... 58-34458
Mar. 11, 1983 [JP] Japan ..... 58-39073

[51] Int. Cl.[4] ..... G03G 15/10; G03D 7/00; G03D 5/00

[52] U.S. Cl. ..... 355/10; 354/300; 354/317

[58] Field of Search ..... 355/10, 3 R; 354/300, 354/317; 118/647, 662

[56] References Cited

U.S. PATENT DOCUMENTS 3,916,828 11/1975 Gross ..... 118/647
3,936,854 2/1976 Smith ..... 355/10
3,964,828 6/1976 Yamada et al. ..... 355/10
4,141,647 2/1979 Lempke et al. ..... 355/10
4,435,071 3/1984 Kuehnle ..... 355/10

*Primary Examiner*—Arthur T. Grimley
*Assistant Examiner*—C. Romano

[57] ABSTRACT

A developing head in which liquid developer and gas are applied by a feeding system to the photosensitive surface of an electrophotographic material for electrophotographic apparatus via a developing chamber, a space being formed between the framed opening of the developing mask at its outer peripheral surface and an opposing photosensitive surface to prevent leakage of the liquid developer by capillarity between the photosensitive surface and the framed opening of the developing mask at its mouth abutting the photosensitive surface, a valve interposed between the passageways for feeding liquid developer and gas respectively in order to prevent the liquid developer from flowing into the passageway for supplying gas, and a pressure reduction apparatus to apply negative pressure between the photosensitive surface and the mouth of the framed opening when the electrophotographic material is advanced from one frame to another.

13 Claims, 21 Drawing Figures

DEVELOPING HEAD FOR ELECTROPHOTOGRAPHIC APPARATUS

BACKGROUND OF THE DISCLOSURE

The present invention relates to a developing head for electrophotographic apparatus which is capable of effectively supplying a liquid developing agent by a liquid feeding means.

Unlike conventional photographic film which uses silver halide photographic as the photosensitive member, electrophotographic material has a feature that it becomes photosensitive only after it is electrically charged. For these characteristics, a roll of elongated film is used as the electrophotographic material for microfilm which is charged, exposed, developed and fixed in part for recording an image, and serviced for projection of the thus obtained images together with unrecorded portions and images which are newly added to the unrecorded portions thereof.

So-called wet type electrophotographic apparatus which employs microfilm such as mentioned above develops electrostatic latent images by using a liquid developer and by charging, exposing, developing, drying and fixing the electrophotographic material frame by frame. It is therefore desirable that the liquid developer should not overflow from or leak into regions on the electrophotographic material other than where it should be treated for developing. It is also preferable that the excess liquid developer be removed as quickly as possible before the electrophotographic material is detached from the developing head and forwarded to subsequent processing sections.

FIG. 1(*a*) is a schematic view to show the structure of the developing head according to the prior art. As is shown in the figure, a developing head 1 is provided with a developing mask means 2. The developing mask means 2 has an opening with a frame 2*a* which is identical in size to one frame of an electrophotographic material 3 for an electrophotographic apparatus. The mouth 2*b* of the framed opening is in contact with the electrophotographic material 3. The outer frame surface 2*c* of the developing mask means 2 opposes the electrophotographic material 3 over a limited space. The inlet port 2*d* for liquid developer in the developing mask means 2 connects with the tip of a passageway 4. The base of the passageway is immersed in the liquid developer 5 pooled in a toner tank 7. The tip of a passageway 8 interposed with a pump 6 is connected to the outlet port 2*e* in the developing mask means 2, and the base thereof is located in the upper space of the toner tank 7. The inlet port 2*d* and the outlet port 2*e* for the liquid developer communicate via a passageway 2*f*. As the vacuum pump 6 is actuated, the pressure inside the chamber passageway 2*f* becomes negative, so that the liquid developer 5 is introduced into the chamber passageway 2*f* via the passageway 4 to come in contact with the electrophotographic material 3 which is formed with electrostatic latent images for developing in the developing chamber 2*g* which is an opening defined by the frame 2*a*. The liquid developer 5 after developing is sucked and returned to the toner tank 7 by the vacuum pump 6.

FIG. 2 is a schematic view to show the structure of another prior art developing head which is so structured as to remove the liquid developer 5 from the photosensitive surface 3*a* (hereinafter termed as squeezing).

As is shown in this figure, the developing head 1 of this type is provided with a developing mask means 2, which has an opening with a frame 2*a* identical in size with one frame of the electrophotographic material 3. The mouth 2*b* of the framed opening is in contact with the electrophotographic material 3. Thus, the photosensitive surface 3*a* which is one frame of the electrophotographic material 3 faces the developing chamber 2*g*. The liquid developer 5 is applied to the photosensitive surface 3*a* via the developing chamber 2*g* to obtain a predetermined latent image. In this case, the liquid developer 5 on the photosensitive surface 3*a* is then squeezed off from the surface 3*a* by injecting, for example, gas such as air onto the surface 3*a*. In order to do this, it is necessary to send the liquid developer 5 and the gas (in this case, air) into the developing chamber 2*g*. This is done by pumping up the liquid developer 5 pooled in the toner tank by means of the vacuum pump 6, which also draws the air in from the atmosphere as the valve 9 opens. In other words, there are provided passageways 4 and 8 which extend from the toner tank 7 into the developing mask means 2 and return to the toner tank 7 via the developing chamber 2*g* and the vacuum pump 6, and another passageway 10 which has its end portion opening into the atmosphere and extends into the developing mask means 2 via the valve 9 to joint the passageway 4 at the upstream from the developing chamber 2*g*. A pressing plate 12 abuts against the electrophotographic material 3 at its back to press the same toward the mouth 2*b* of the framed opening during developing and subsequent squeezing of the liquid developer 5. Its pressing is released when the electrophotographic material is advanced from one frame to the other for the next processing step.

On the other hand, the developing head 1 as shown in FIGS. 1(*a*) and 2 utilizes the vacuum pump 6 for feeding the liquid developer 5 or the liquid developer 5 and the gas for squeezing said agent. Because the vacuum pump 6 is expensive, the developing head 1 becomes costly and difficult to reduce in size as well as in price.

Such problems can be overcome if a compression-feeding means such as a liquid feeding pump is used instead of the vacuum pump 6, but this again entails other problems such as:

(a) As the liquid developer 5 is introduced into the developing chamber 2*g* under pressure applied by the compression means, there is danger that the liquid developer 5 might leak through the interstice between the mouth 2*b* of the framed opening and the photosensitive surface 3*a*. Such leakage would cause the liquid developer 5 to disperse over the entire area of said interstice by the capillarity since the interstice between the outer peripheral surface 2*c* and the electrophotographic material 3 is very narrow and the angle between the two is very small (ca. 5°). The liquid developer 5 would eventually spread over the other areas of the electrophotographic that are not yet to be contacted with the liquid developer. Or, it may even flow into other parts of the electrophotographic apparatus. This is particularly marked in the developing head 1 shown in FIG. 1(*a*), the portion A thereof shown as an enlarged view in FIG. 1(*b*).

A developing head which is free from leakage of the liquid developer has been proposed, such as disclosed in Japanese Patent Publication No. Sho-51-13415, in which the mouth of the framed opening to be contacted with the electrophotographic material is made of a resilient member such as rubber. However, the use of a rubber mask at the mouth of the framed opening will involve an extra manufacturing process of pasting the rubber with adhesive. This will lead to a cost increase as well as trouble due to a stagnant liquid developer in the bonded portion and an inferior durability of the rubber mask. Also, if the developing head is made integral with the charging/exposing head, the use of a resilient member in the developing mask means results in unstable positioning of the electrophotographic material with respect to the developing head. This then affects the positioning of the lens with respect to the electrophotographic material which requires precision in reproduction.

(b) With the developing head 1 in which the liquid developer 5 is squeezed after developing such as shown in FIG. 2, the distance between the photosensitive surface 3*a* in the developing region and the developing electrode 11 is generally very narrow, whereby the liquid developer is likely to enter into the passageway 10 for feeding the gas because of the liquid resistance caused by the viscosity of the liquid developer. If the liquid developer enters into the pump, it would cause various problems, and the liquid developer entering into the passageway 10 would be jetted into the developing chamber 2*g* to reduce the squeezing efficiency when the pump is activated.

(c) Moreover, although the liquid developer 5 is squeezed by applying the gas to the photosensitive surface 3*a*, this is not sufficient. Squeezing may become adequate if sufficient time is allowed, but this too would cause another problem of reduced processing efficiency per unit time.

U.S. Pat. No. 3,916,828 and U.S. Pat. No. 4,141,647 are referred to as the prior art in relation to FIG. 1 or 2.

SUMMARY OF THE INVENTION

In view of the defects found in the prior art, the present invention aims to provide a developing head for an electrophotographic apparatus capable of satisfactory developing even with the use of the feeding means for supplying the liquid developer alone or for supplying the liquid developer with squeezing gas. The second object of the present invention is to provide a developing head which is inexpensive and free from the leakage of the liquid developer. The third object of the present invention is to provide a developing head with a squeezing process which is capable of preventing the liquid developer from coming into a piping for squeezing gas. The fourth object of the present invention is to provide a developing head which is capable of squeezing the liquid developer effectively and more quickly in the squeezing process.

In the developing head for electrophotographic apparatus according to the present invention which comprises a developing mask having a developing chamber defined by a framed opening facing the photosensitive surface of an electrophotographic material for an electrophotography, the mouth of said opening abutting on said photosensitive surface, and the outer peripheral surface of said developing mask opposing the photosensitive surface, which is contacted with the liquid developer supplied from a liquid feeding means via said developing chamber to achieve development of the electrophotographic material via an interval the developing head is characterized in that:

a bent or curved portion is formed near the mouth of the framed opening to assume an angle greater than that formed between the rest of the outer peripheral surface of the developing mask and said electrophotographic material so that a space can be formed to prevent the liquid developer from leaking between said bent portion and the electrophotographic material by capillarity;

a first passageway is provided exclusively for supplying the liquid developer;

a feeding means for supplying gas onto the photosensitive surface in order to squeeze the liquid developer therefrom after it contacted with the surface.

a second passageway is provided exclusively for supplying the gas;

a valve is provided to close said second passageway when the liquid developer is supplied;

a pressing mechanism is provided to press the electrophotographic material against said mouth of the framed opening during the developing process to apply the liquid developer and during the squeezing process to apply the gas to remove the liquid developer, said press being released when the electrophotographic material is forwarded for one frame, a reduction means is provided to apply a negative pressure to the interval between the photosensitive surface and at least a portion of the mouth of the frame opening of the developing mask means.

BRIEF DESCRIPTION OF THE DRAWINGS

In the accompanying drawings, FIG. 1(*a*) is a schematic view to show the structure of the developing head according to the prior art.

FIG. 3(*b*) is an enlarged view of the portion B in FIG. 3(*a*).

FIG. 14(*a*) is a front view of the processing head; FIG. 14(*b*) is a sectional side view of pressing plate. FIG. 15 is a partial sectional view of still another embodiment of the pressing plate of the present invention.

DETAILED DESCRIPTION OF THE PREFERRED EMBODIMENTS

Figure 1A:
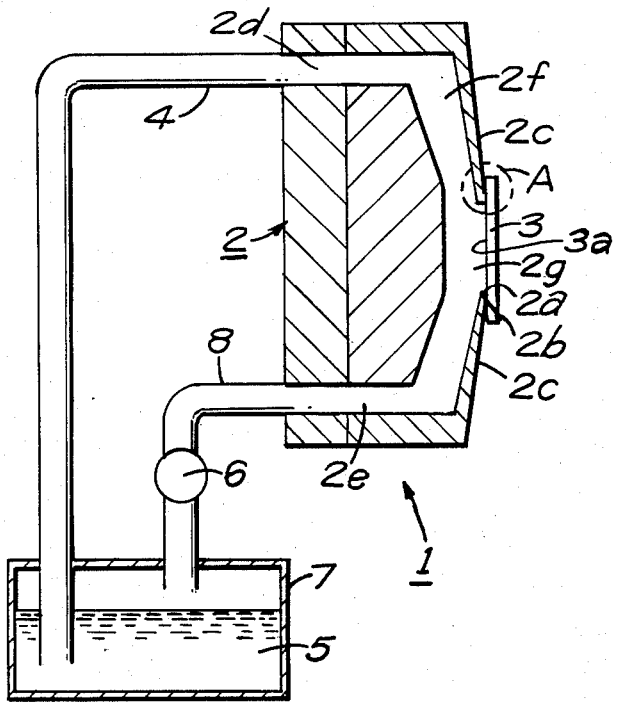
(PRIOR ART) FIG. 1(a)
FIG. 1(*b*) is an enlarged view of the portion A in FIG. 1(*a*).
Figure 1B:
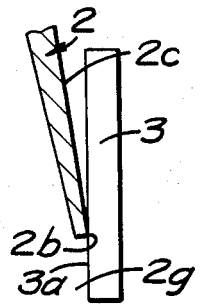
PRIOR ART) FIG. 1(b)

The preferred embodiments of the present invention will now be described in detail referring to the accompanying drawings. The parts identical with the prior art head are given identical reference numerals.

Figure 3A:
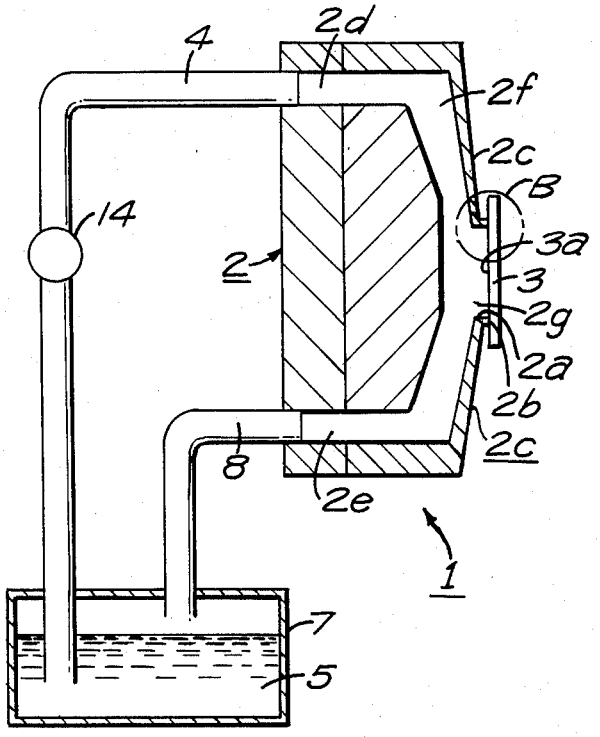
FIG. 3(*a*) is a schematic view to show the structure of one embodiment according to the present invention.
Figure 3B:
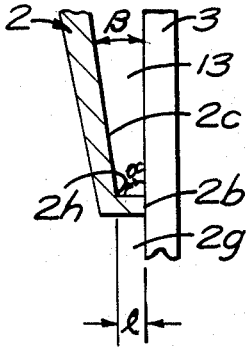
Figure 4:
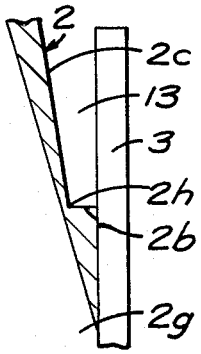
FIGS. 4 through 7 are enlarged views of the portion B in various modifications of the present invention.

FIG. 3(*a*) shows the first embodiment according to the present invention, with its portion B shown in enlarged view in FIG. 3(*b*). As shown in these figures, a bent portion **2*h* is formed on the framed opening near the mouth 2*b* thereof. The angle $\alpha$ between the outer surface 2*c* near the mouth 2*b* of the framed opening and the electrophotographic material 3 is 90° and the angle $\beta$ between the rest of the outer surface 2*c* and the electrophotographic material 3 is about 5°. The outer surface 2*c* is spaced from the electrophotographic material 3 at a distance l of about 1 mm at the bent portion. Thus, a relatively large space 13 is made between the outer surface 2*c* of the developing mask means and the electrophotographic material 3 to prevent leakage. In other words, even if the liquid developer 5 supplied by means of a compression pump 14 seeps through the space between the mouth 2*b* of the framed opening and the electrophotographic material 3, there occurs no capillarity because the interval 13 for preventing the leakage is quite large. Instead, the liquid developer 5** will be prevented from dispersing any further.

Referring to FIG. 3(*b*), an interstice is generally present to a certain extent between the electrophotographic material 3 and the mouth **2*b* of the framed opening of the developing mask means which abuts against the electrophotographic material 3 due to limited manufacturing precision and the planar deviation caused by the pressing plate. With the head in this embodiment as well as in all the other embodiments hereinafter, the interstice can be reduced to 25 μm or less over the entire mouth 2*b***. This permits the liquid developer to be applied to the developing head for a longer period of time without leaking.

Observation of liquid behavior in terms of dynamics at the developing head reveals that the force F (per unit length) acting on the liquid present in between the electrophotographic material 3 and the mouth **2*b*** of the framed opening in the outward direction can be expressed as:

$$F = t \cdot P + \delta(1 + \cos\alpha) - 2\delta$$
$$= t \cdot P - \delta(1 - \cos\alpha)$$

wherein: t represents the interstice between the electrophotographic material 3 and the mouth **2*b* of the framed opening; P, the pressure within the developing head; δ, surface tension (shown in Table 1) of the liquid developer 5; and $\alpha$, the angle formed by the electrophotographic material 3 and the outer surface 2*c*** of the mask as shown in FIG. 3(*b*).

TABLE 1

| | |
|---|---|
| cyclohexane | 25 dyn/cm |
| decane | 23.9 dyn/cm |
| dodecane | 25.4 dyn/cm |
| toluene | 28.4 dyn/cm |

As is seen in Table 1, the surface tension of the liquid developer 5 is in the range of between 20 and 30 dyn/cm. Suppose the pressure within the developing head 1 is several ten grams weight/cm$^2$, the force F assumes a negative value if the angle $\alpha$ is in the proximity of 90°, whereby leakage of the liquid developer 5 can be prevented. It is preferable that the mouth **2*b* of the framed opening be spaced from the electrophotographic material 3 by a distance within 0.3 mm in order to prevent a large amount of the liquid developer 5 from overflowing even if the pressure of the pump which feeds the liquid developer 5 temporarily increases and the surface tension of the agent fails to prevent flowing. The viscosity of the liquid developer 5** would in this case prevent its flowing.

Figure 5:
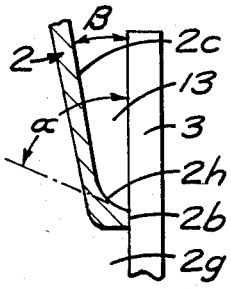
Figure 6:
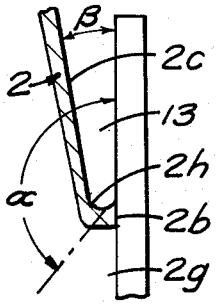
Figure 7:
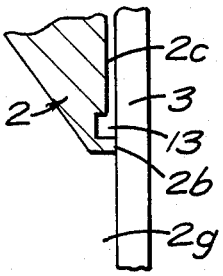

Referring now to FIGS. 4 through 7 which show the essential parts of modified embodiments in enlargement. The embodiment shown in FIG. 4 comprises the developing mask means 2 with its surface facing the passageway **2*f* being made flat so that the liquid developer 5 can easily make contact with the electrophotographic material 3. The modified embodiment shown in FIG. 5 is formed with a bent portion 2*h* which is so curved as to satisfy the relation, which is the angle $\alpha >$ the angle $\beta$, in order to form the interval 13 for leakage prevention. Further, the angle $\alpha$ of the embodiment shown in FIG. 6 is made still greater, so that the capillarity of the liquid becomes less likely to occur. In FIG. 7, an annular groove profiling the shape of the framed opening 2*a* is made on the outer surface 2*c* of the developing mask means near its mouth 2*b* to provide the modified space 13. This space 13** is also effective in preventing leakage as mentioned in the foregoing embodiments.

The developing mask means 2 to be used in the embodiments according to the present invention must be made from a material which would not deform when the electrophotographic material 3 is pressed against the mouth **2*b*** of the framed opening, or even if it should deform, the positional displacement of the electrophotographic material due to deformation at the charging-/exposing head should fall within the optically permissible tolerance. More specifically, various resins such as acryl, polystyrene, vinyl chloride, epoxy polycarbonate, phenol, polyphenylene oxide, polyacetal, diaryl phtalate, nylon, urea, unsaturated polyester resins; metals such as aluminum alloys, iron alloys, copper alloys; or ceramics having alumina as the principal ingredient can be used to achieve the objective.

According to the present embodiment, the liquid developer can be supplied free of leak even if the pressure inside the developing chamber is equivalent to or slightly higher than the pressure outside. The present embodiment, therefore, can achieve cost reduction since conventional pumps can be used as the feeding means to supply liquid developer. Presence of the interval between the outer surface of the developing mask means and the electrophotographic material is quite effective in preventing the liquid developer from leaking.

Needless to say, this invention is effectively applicable for the case where a pressure reducing pump is utilized as the feeding means for the liquid developer.

Figure 8:
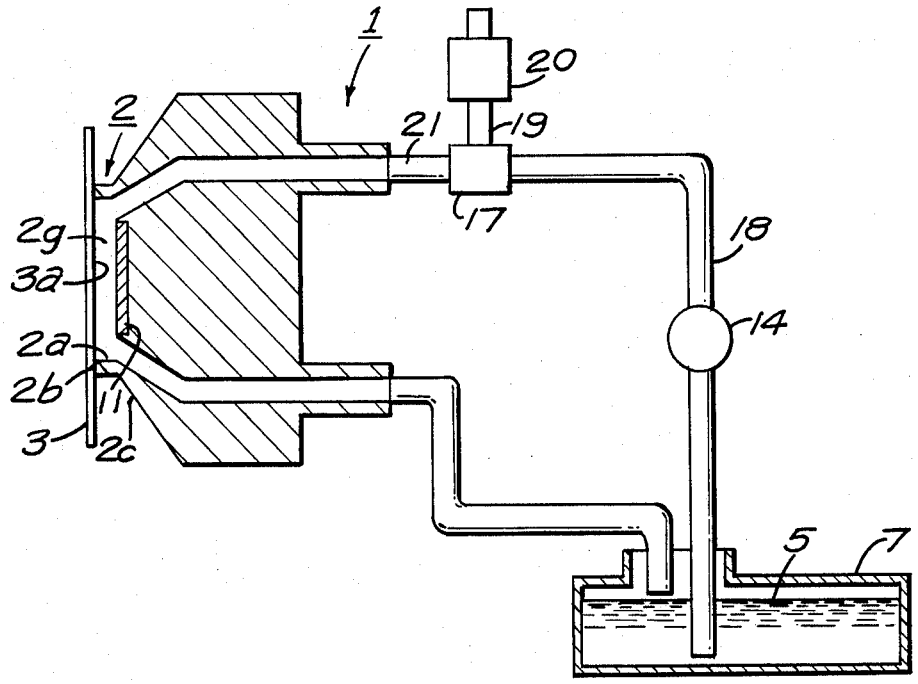
FIG. 8 is a schematic view to show the structure of the second embodiment according to the present invention.

Referring now to FIG. 8 which is a schematic view to show the structure of the second embodiment according to the present invention, the developing head 1 is provided with the developing mask means 2 of the prior art as mentioned above. The developing mask means 2 has a framed opening **2*a* with an area corresponding to that of one frame of the electrophotographic material to be developed. The mouth 2*b* of the framed opening 2*a*** abuts against the electrophotographic material 3. As a result, the photosensitive surface 3*a*, or one frame of the electrophotographic material 3 is exposed to the developing chamber 2*g*. By applying the liquid developer 5 via the developing chamber 2*g*, a predetermined latent image can be developed on the surface 3*a*. After developing, air can be introduced to squeeze off the residual liquid developer 5. The first passageway 18 has its one end opening into the toner tank 7 where the liquid developer is pooled and functions as the exclusive passageway for the liquid developer 5 by means of a compression pump 14 interposed in the midway. Various pumps known in the art such as the Emperor type pump, gear pump, and vane pump can be used as the compression-feeding pump 14. The second passageway 19 has its one end opening into the atmosphere and exclusively feeds the air which is sucked by the air pump 20 interposed in the midway of the passageway. The other ends of the passageways 18 and 19 respectively are connected to a valve 17. The valve 17 is also connected to the inlet port of the third passageway 21 which communicates with the developing chamber 2*g*. The valve 17 closes the connection between the second passageway 19 and the third passageway 21 when the liquid developer 5 is fed under pressure. The valve 17 opens the connection between the second passageway 19 and the third passageway 21 when the liquid developer 5 is not fed. The valve 17 prevents the liquid developer 5 from flowing into the second passageway 19 which is a passage for feeding the gas, whereby effective squeezing of the liquid developer as well as developing can be achieved.

Figure 9A:
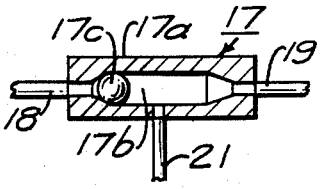
FIGS. 9(*a*) through 9(*c*) are sectional views of the present invention to show the details of the valves shown in FIGS. 8 and 10.
Figure 9B:
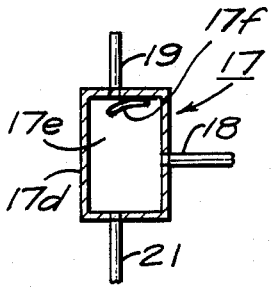
Figure 9C:
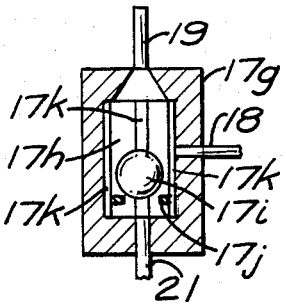

A valve 17 may be a solenoid valve which is structured to be actuated in sequence aligned with the developing process. As shown in FIGS. 9(*a*) through (*c*), if an automatic valve is used, the apparatus can further be reduced in size and cost. The valve 17 shown in FIG. 9(*a*) comprises a housing 17*a*, a cavity 17*b* formed in said housing 17*a*, and a ball 17*c* contained in said cavity 17*b*. The valve 17 is three-directional, communicating with passageways 18, 19 and 21 via the cavity 17*b*. Thus, while the liquid developer is supplied, or when the compressive feeding pump 14 is operating, the liquid developer 5 presses the ball 17*c* to move toward the right in the drawing and close the second passageway 19. As the feeding is suspended, or when the air pump 20 is actuated to supply the air, the air presses the ball 17*c* toward the left in the drawing to open the second passageway 19 and concurrently close the first passageway 18. The valve 17 shown in FIG. 9(*b*) comprises a housing 17*d*, a cavity 17*e* formed therein and a thin plate valve member 17*f* provided at the mouth of the second passageway 19. This valve is also three-directional, communicating with the passageways 18, 19 and 21 via the cavity 17*e*. Thus, when the liquid developer is introduced, the liquid developer presses the valve member 17*f* upward in the drawing to close the second passageway 19. When the air is supplied, the air presses the valve 17*f* downward in the drawing to open the second passageway 19. With the valve 17 as mentioned above, the first passageway 18 is open at all times. The valve 17 shown in FIG. 9(*c*) comprises a housing 17*g*, a cavity 17*h* formed therein and a ball 17*i* contained in said cavity 17*h*, and the passageways 18, 19 and 21 are communicating with the cavity 17*h*. Because of the projections 17*j* provided in the cavity 17*h*, the ball 17*i* will not drop of its own weight. With this arrangement, the air coming into the cavity 17*h* via the second passageway 19 will be guided to the third passageway 21 via the groove 17*k* provided on the inner wall of the housing 17*g*. On the other hand, when the liquid developer 5 is introduced, the ball moves upward in the drawing to close the second passageway 19. In other words, the width of the cavity 17*h*, the weight and the diameter of the ball 17*i* and the diameter of the second passageway at the mouth are so selected so as to prevent the liquid developer 5 from flowing into the second passageway 19 when the ball 17*i* moves upward and the ball 17*i* is lighter in weight than the liquid developer 5. Thus, when the liquid developer is introduced, it presses the ball 17*i* upward to close the second passageway 19. When the air is introduced, or at the suspension of liquid developer feeding, the ball 17*i* comes down by its own weight to reach the projections 17*j* to open the second passageway 19. The first passageway 18 stays open at all times with this valve.

Figure 2:
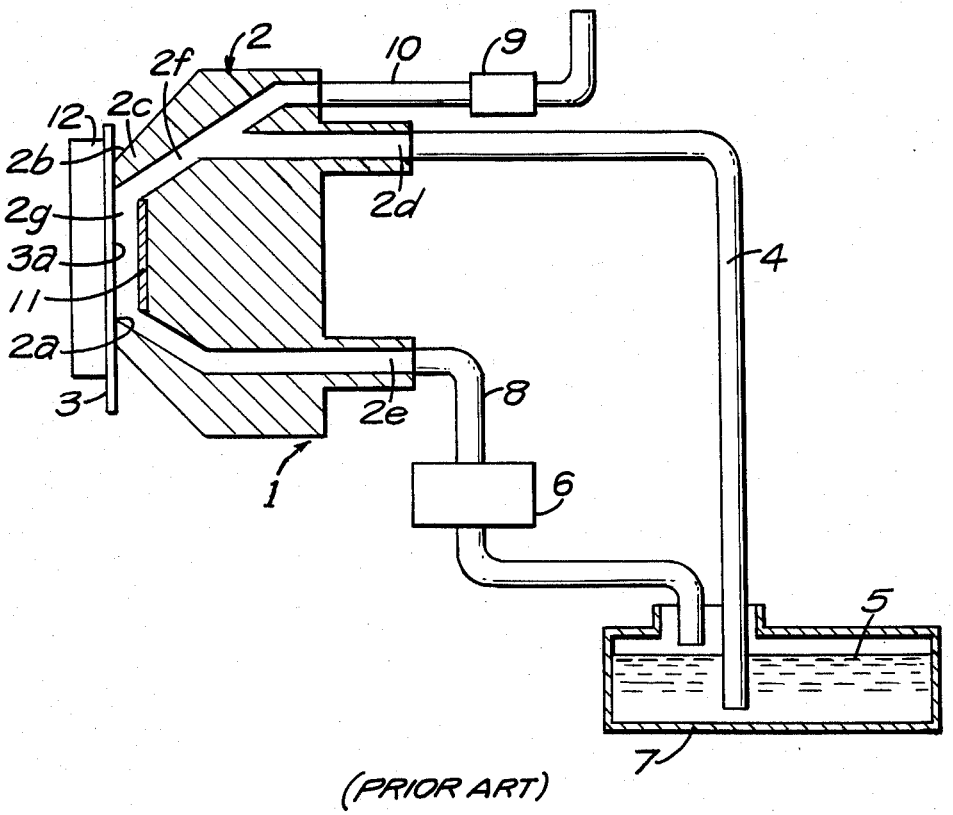
(PRIOR ART) FIG. 2
FIG. 2 is a schematic view to show the structure of another developing head according to the prior art.

In the second embodiment of the present invention, the valve 17 closes the second passageway 19 as the compression-feeding pump is actuated to feed the liquid developer 5 and prevents the liquid developer from flowing into the passageway. The liquid developer 5 will be applied to the photosensitive surface 3*a* via the third passageway 21 and the developing chamber 2*g*. One might conceive of modifying the feeding systems for liquid developer and the air in the developing head shown in FIG. 2 into a compression type as obtained in the foregoing embodiment. However, the liquid developer 5 will flow and stay in the section of the passageway 10 between the valve 9 and the junction where the passageways 10 and 4 meet. The stagnant liquid developer 5 will then be mixed with the air in the subsequent squeezing process and blown over the photosensitive surface 3*a* to either smear it or reduce the squeezing efficiency. In the squeezing process following the developing, the valve 17 opens the second passageway 19 as the air pump 20 is actuated for squeezing and introduces the air onto the photosensitive surface 3*a* via the third passageway 21 and the developing chamber 2*g*. With the valve 17 shown in FIGS. 9(*b*) and 9(*c*), the first passageway 18 is open at the same time, so that a portion of the air will flow into the passageway 18 but this gives no adverse influence.

Figure 10:
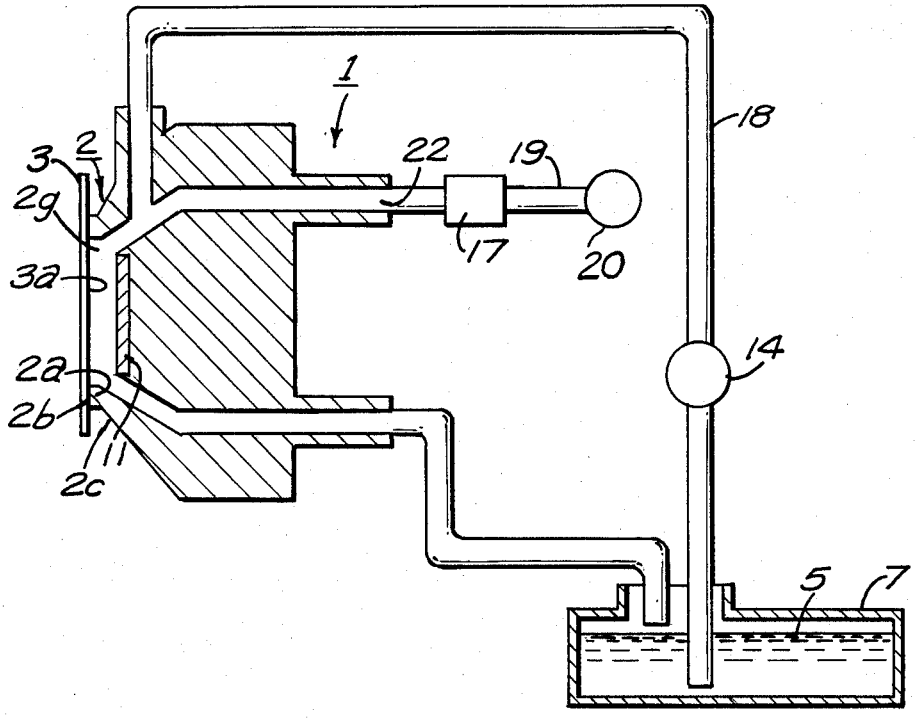
FIG. 10 is a schematic view to show the structure of the third embodiment according to the present invention.

The third embodiment of the present invention is shown in FIG. 10. In this embodiment, the valve 17 is provided in the second passageway 19 on the side of the developing head. The liquid developer 5 is supplied directly to the developing mask means 2 via the first passageway 18. The valve 17 may be one-directional that allows the liquid developer 5 to flow from the passageway 19 to the developing mask means. This reduces the cost and simplifies the operation. Moreover, because the air is present in the passageway 22 as the valve 17 is closed by the actuation of the pump 14, the liquid developer 5 will not reach the valve 17, protecting more area in the piping from the liquid developer. This further prevents the photosensitive surface 3*a* from being soiled at the time of squeezing.

In the embodiments shown in FIGS. 8 and 10, the air pump 20 is employed as a compression-feeding means for the gas. Similar effect and action can be obtained by connecting the passageway 19 with a bomb containing compressed gas or liquified gas. In this case, gasses such as carbon oxide, frorocarbon, propane and butane can be used as the squeezing gas other than air. Liquid content of the liquid developer will drop by its weight toward the lower part of the photosensitive surface 3*a* because the surface 3*a* is positioned to be vertical or substantially vertical as shown in FIGS. 8 and 10. It may therefore be more effective to spray the squeezing gas against said lower portion of the surface 3*a*.

Thus, according to the second and third embodiments, the compression-feeding system of the liquid developer and the squeezing gas not only results in simplified structure but also prevents the flow of the liquid developer into the second passageway which is exclusively for feeding the gas.

Figure 11:
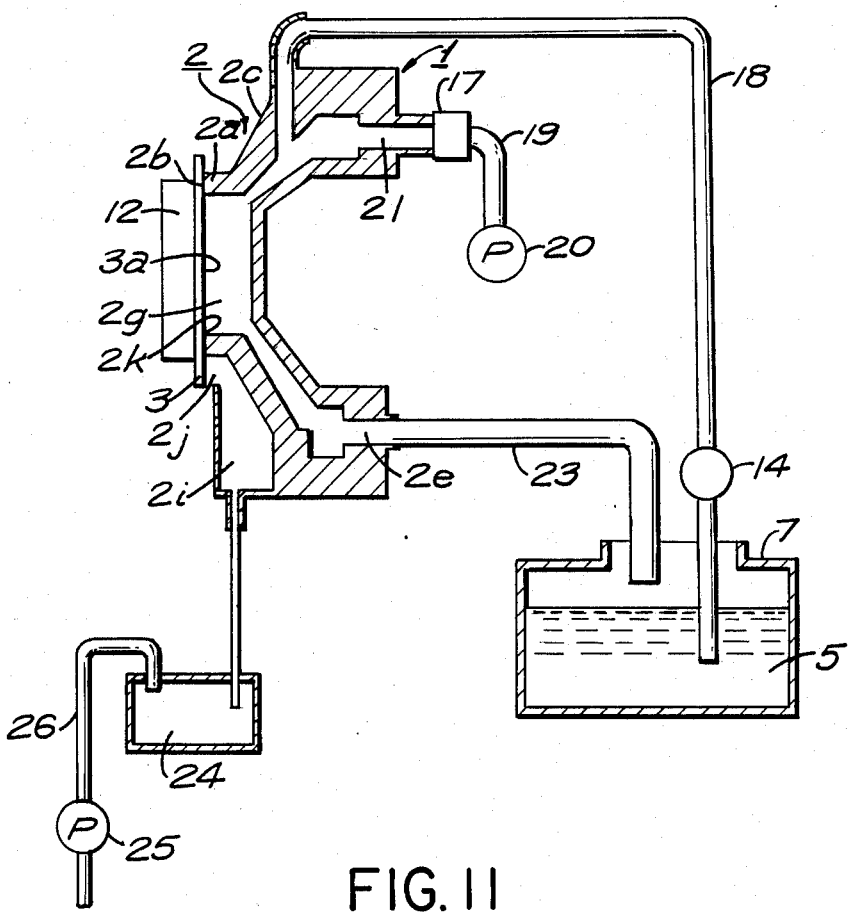
FIG. 11 is a schematic view to show the structure of the fourth embodiment according to the present invention.

FIG. 11 is a schematic view of the fourth embodiment to show its structure. As shown in the drawing, the developing head 1 is provided with a mask means 2 having an opening with a frame 2*a* which is identical in area with one frame of the electrophotographic material 3 and in abutment therewith. One frame of the photosensitive surface 3*a* of the electrophotographic material 3 therefore faces the developing chamber 2*g*. By applying the liquid developer 5 via the chamber 2*g* while pressing the electrophotographic material against the developing mask means 2, an electrostatic latent image is developed. Air is then applied to the photosensitive surface 3*a* for squeezing. More specifically, the liquid developer 5 is pumped out from the toner tank 7 where the liquid developer is pooled and supplied via the first passageway 18. The air for squeezing is supplied via the second passageway 19 which opens into the atmosphere at one end and is provided with the air pump 20 at its midway which acts as a compressive gas feeding means. In other words, the liquid developer 5 and the squeezing air are both supplied by compressive means instead of suction means as employed in the prior art. The valve 17 is therefore provided in the second passageway 19 to prevent the flow of the liquid developer 5 into the passageway 19 or the air pump 20. The excessive liquid developer 5 after developing on the surface 3*a* and the air after squeezing return to the toner tank 7 through the outlet port 2*e* which is formed in the developing chamber 2*g* to communicate with the fourth passageway 23 for discharging the liquid developer. In this way, the liquid developer 5 pumped out from the toner tank by the compressive pump 14 is applied to the photosensitive surface 3*a* to develop a given latent image and then squeezed off by the air sucked in by the air pump 20. After developing and squeezing, the pressing plate 12 on the electrophotographic material 3 is released and the electrophotographic material 3 is forwarded by one frame.

The developing mask means 2 of this embodiment is further formed with a suction channel 2*i*. One end of the suction channel 2*i* opens into the atmosphere via the suction port 2*j*. The other end thereof is connected to a passageway 26 for suction which opens into the atmosphere and which is interposed with a trap 24 and a reduction means such as a suction pump 25. The suction port 2*j* of the suction channel 2*i* communicates with the bottom end 2*k* of the developing chamber 2*g* via the interval between the developing mask means 2 and the electrophotographic material 3. When the suction pump 25 is in operation and the electrophotographic material is pressed against the developing mask means 2, the liquid which has leaked through the interstice between the side of the frame 2*b* and the photosensitive surface 3*a* is sucked out via a suction member 2*j*. After the excess liquid is squeezed off by air, the pressing plate 12 is released from the electrophotographic material 3 for forwarding the same by one frame. As the interval between the lower end of the developing chamber 2*g* and the electrophotographic material 3 is widened, air flows into the suction member 2*j* via the expanded interval to blow off the liquid developer which still remains on the lower end of the photosensitive surface 3*a*.

As the pressing plate 12 is released from the electrophotographic material 3 for forwarding the same by one frame after developing and subsequent squeezing processes, the suction force of the suction pump 25 will act on the space made between the electrophotographic material 3 and the developing mask means 2 to suck the liquid developer dripping from the bottom end 2*k* due to squeezing and discharge the same from the passageway 26 via the trap 24 which acts as a filter. The developing head of this construction is capable of adequately squeezing off the excessive liquid developer from the photosensitive surface 3*a*. The structure mentioned above contributes to satisfactory squeezing of the residual liquid developer 5 on the surface 3*a*. In the prior art, there were about 1 to 2 mg of residual liquid developer per 1 $cm^2$ on the surface 3*a*. This was reduced to about 0.3 $mg/cm^2$ in the present invention. The present invention further allows the various parts with the dimension of $t_1=0.1$ to 0.5 mm and $t_2=0.3$ to 0.5 mm. The suction pump 25 may be any inexpensive reduction means such as a vane pump, an electromagnetic pump, a diaphram pump or a gear pump of about $-50$ mm $H_2O$.

Although the trap 24 is provided in front of the suction pump 25 to separate the dripping liquid and the gas and to thereby prevent the liquid from flowing into the suction pump 25, said trap 24 may be omitted if a solvent-resistant pump is employed to return the liquid directly into the toner tank 7.

Figure 12:
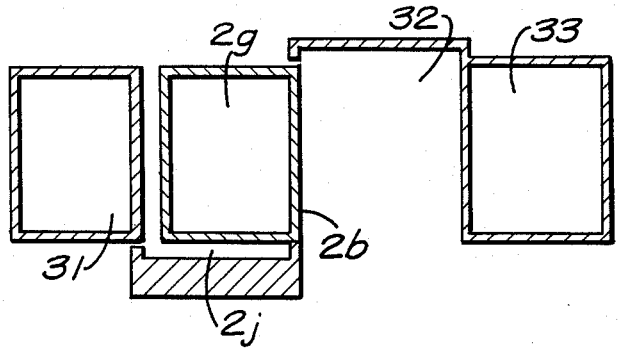
FIG. 12 is an explanatory view to show the parts of the processing head shown in FIG. 11 when viewed from the front.

FIG. 12 shows the portions of the processing head that can be seen from the front. The processing head integrates various processing sections. In the figure, the reference numeral 31 denotes the charging/exposing chamber; 2*g* the developing/squeezing chamber; 32 the drying chamber; and 33 the fixing chamber, at their openings respectively. The construction of this embodiment allows the liquid developer and the squeezing gas to flow from the upper toward the lower portion of the developing chamber 2*g*. The suction port 2*j* is therefore located at downstream of the developing chamber 2*g* and extends as far as to the charging/exposing chamber in order to protect the chamber from the seeping liquid developer. It is also possible to locate the suction port 2*j* on the side of the drying chamber. When the squeezing gas is introduced from the side instead of from the upper portion, it is more effective to locate the suction port 2*j* at the farthermost downstream of the gas flow. As has been mentioned, it is more effective to locate the suction port 2*j* either at the lower portion of the developing cell 2*g* or at the farthermost downstream of the gas flow. It is still more effective to locate the suction port 2*j* at other peripheral portions of the developing cell 2*g* to suck the liquid developer 5 remaining on the edge of the mouth 2*b* of the famed opening which is in abutment with the electrophotographic material 3.

In principle, the suction sump 25 is actuated to act on said interval only when the pressing plate is released for forwarding the electrophotographic material by one frame. However, it may be operated continuously during the developing process as well.

Further in the embodiments shown in FIGS. 3(*a*), 8, 10, and 11, although a compression pump is employed to feed the liquid developer, a conventional suction means such as a suction pump may be used for such a purpose and the suction means according to this invention may be used exclusively for sucking the dripping liquid remaining after the squeezing process.

Figure 16:
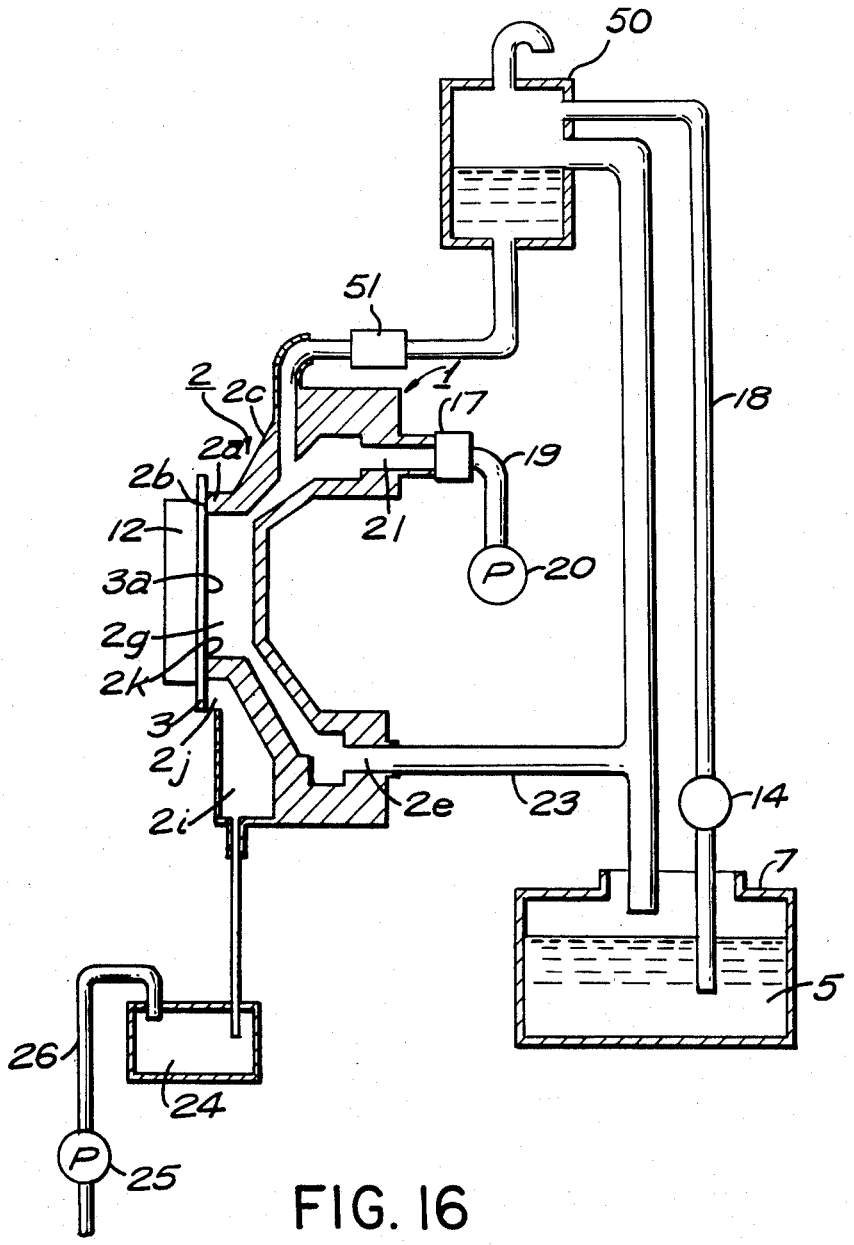
FIG. 16 is a schematic view of another embodiment in which an auxiliary toner tank and stop valve is added to the system of FIG. 11.

Another embodiment of the means to feed the liquid developer into the developing chamber 2g is shown in FIG. 16 which illustrates a system including an auxiliary toner tank 50 for the liquid developer provided above the chamber 2g wherein the liquid developer is cycled constantly between the auxiliary toner tank 50 and the toner tank 7, and at the time of developing, the liquid developer stored in the auxiliary toner tank 50 is supplied to the chamber 2g by opening the stop valve 51. As the surface of the liquid developer is maintained constant so that the liquid developer drips into the developing chamber by its own weight in the above system, the liquid developer can be fed to the chamber 2g at a constant pressure, a constant flow rate and free of influence of the pulsation of the pump, thereby enhancing the effect of this invention.

This embodiment enables thorough and quick squeezing of the residual liquid developer stagnant at the bottom of the developing head by sucking through the interval between the electrophotographic material and the developing mask means which appears when material is forwarded by one frame.

Figure 13:
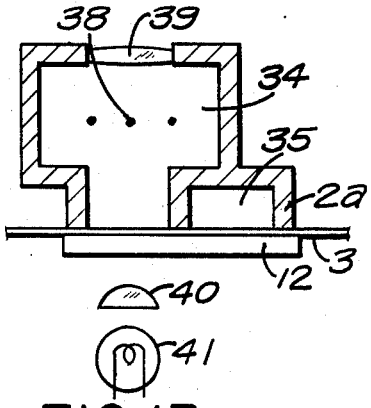
FIG. 13 is a partial sectional view of the processing head according to the prior art.

An integral processing head of FIG. 12 which is capable of charging, exposing, developing and fixing may be constructed as shown in FIG. 13.

FIG. 13 shows the processing head at its charging-/exposing section 34 and the developing section 35. Corona ions from the discharge electrode 38 in the charging/exposing section 34 are uniformly discharged onto the electrophotographic material 3 where the light from the lens 39 is focused for exposing to form a pattern of residual charges or the latent image. The electrophotographic material 3 is then sent for one frame so that the exposed frame would fit in the opening frame 2a in the developing section 35 and the liquid developer 5 is applied on the surface of the electrophotographic material 3 for developing. A pressing plate 12 is provided to press the electrophotographic material 3 against the processing head in order to precisely position the electrophotographic material 3 with respect to the processing head as well as to maintain the same as flat as possible at the charging/exposing section 34. The pressing plate 12 also functions to prevent the developer containing the liquid developer 5 from leaking into the developing section 35. In the charging/exposing section 34, a condensor lens 40 and a projection lamp 41 for projecting the images recorded on the electrophotographic material 3 are located the opposite side of exposure lens 39 with respect to the pressing plate 12.

In an electrophotographic apparatus having a processing head of this construction, exposure and projection can be conducted in the charging/exposing section 34. Because the light is irradiated from both sides of the pressing plate 12, the pressing plate 12 must be made light-permeable. However, there will be an excess of light if the entire pressing plate 12 is made light-permeable.

The illumination on the film surface at the time of projection is about 100,000 Lux, by far greater than the value at the time of exposure which is about 100 Lux. As a consequence, frames other than the one to be projected will also be exposed to extremely strong light, thereby causing fatigue or discoloration of the film and a decrease in film performance, especially so if the adjacent frames are not yet recorded.

Figure 14A:
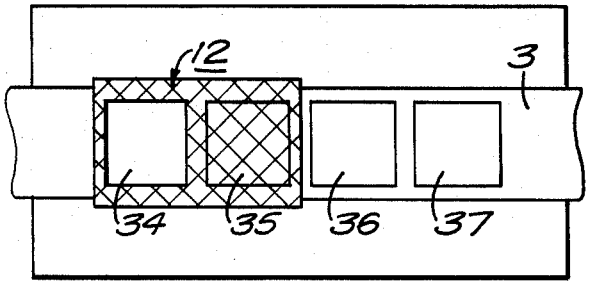
FIGS. 14 and 15 show the pressing plate of the processing head.

Such defects can be overcome by providing a pressing plate 12 of the following construction. That is, FIG. 14(a) shows the total front view of the processing head comprising charging/exposing section 34, the developing section 35, the drying section 36 for drying the liquid developer adherent to the photosensitive surface 3a, and the fixing section 37 where the liquid developer 5 is fixed by heat. The pressing member 12 which presses the electrophotographic material 3 against the processing head while the electrophotographic material 3 is processed for charging, exposing, developing and fixing at the head has the length and the width sufficient to cover the charging/exposing section 34 and the developing section 35. The pressing member 12 is necessary to accurately hold the electrophotographic material 3 in position at the charging/exposing section and to prevent the liquid developer from leaking at the developing section 35.

Figure 14B:
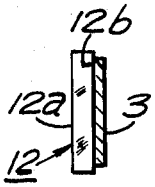

The pressing member 12 is a plate made of metal or plastic which is light-shielding and the portion thereof corresponding to the window of the charging/exposing section of the processing head for introducing the light is made open. The pressing member 12 can also be made of a transparent material 12a such as glass, as shown in FIG. 14(b), with the side facing the electrophotographic material 3 being plated with light-shielding metal 12b or coated with light-shielding paint. If a transparent material 12a is used as the pressing member 12, the portion corresponding to the light window must be made transparent without the metal plating or light-shielding paint. The transparent member 12a as shown in FIG. 14(b) is covered with light-shielding metal plating 12b or paint on the side facing the electrophotographic material 3 in order to prevent the light from filtering into the electrophotographic material 3 through the transparent member 12a.

Figure 15:
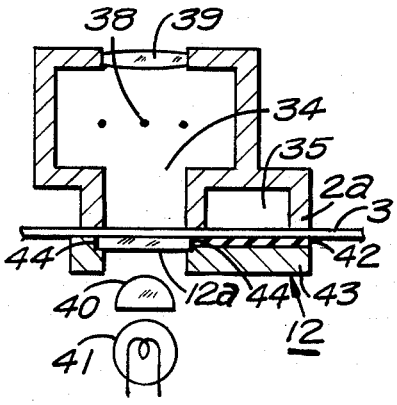

The pressing plate 12 of FIG. 15 is made of a transparent member 12a such as glass at the portion which faces the light window of the charging/exposing section 34 and of a resilient member 42 such as rubber at the portion which faces the developing section 35 adjacent to the charging/exposing section 34. Both the transparent member 12a and the resilient member 42 are affixed to one base 43. The transparent member 12a is again covered with light-shielding film 44 at both ends to prevent the light from spreading. In case the resilient member 42 is light-shielding, the film 44 adjacent to the resilient member 42 can be omitted. The resilient member 42 is provided to press the electrophotographic material 3 firmly against the framed opening 2a so that the liquid developer 5 can be prevented from leaking during the developing. The resilient member 42 is protruded slightly from the adjacent transparent member 12a and securely presses the electrophotographic material 3 against the framed opening 2a by its resilience. The transparent member 12a also functions to securely press the electrophotographic material 3 against the framed opening 2a.

In the embodiments mentioned above, either a light-shielding metal or plastic member provided with an opening, or a transparent member 12a coated with light-shielding metal 12b or paint except for the transparent portion, or a transparent member 12a provided with light-shielding film at both ends and positioned adjacent to the resilient member 42 is employed as the pressing member 12. However, various modifications are possible if the opening or the transparent portion of the pressing member 12 is so constructed as to allow the light to pass while the rest of the member is made light-shielding to prevent the light from spreading onto the electrophotographic material 3.

The use of the pressing plate 12 which is capable of shielding the electrophotographic material 3 from the light except for one frame coming under the light window thereof is therefore effective, especially when the projection lamp 41 is switched on to irradiate the electrophotographic material 3 with very intensive light for one frame under the light window. Thus, even if the material surface adjacent to the surface being projected is not yet recorded, this surface will be shielded from the irradiation and there will be no fear of deteriorating the performance of the electrophotographic material 3.

After developing by applying the liquid developer 5 on the photosensitive surface 3*a* of the electrophotographic material 3, a rinsing liquid which is compatible with and dries more quickly than the solvent of the liquid developer 5 may be poured on said photosensitive surface, drained and then dried. Use of this quick-drying rinsing liquid after developing achieves quick drying of the photosensitive surface 3*a*.

The present invention encompasses the combinations of the four embodiments mentioned above. The combinations include:

(a) the first embodiment with the second or third embodiment;

(b) the second or third embodiment with the fourth embodiment;

(c) the first embodiment with fourth embodiment;

(d) the first, second or third embodiment and fourth embodiment.

What we claim:

1. In a developing head for an electrophotographic apparatus which comprises a developing mask means having a developing chamber defined by a framed opening facing the photosensitive surface of an electrophotographic material for electrophotography, a mouth of said opening abutting said photosensitive surface and an outer peripheral surface of said developing mask means opposing the photosensitive surface and wherein the photosensitive surface is contacted with a liquid developer supplied from a liquid feeding means via said developing chamber to achieve development of the electrophotographic material, the improvement wherein:

a gas applying means is provided to apply gas onto the photosensitive surface via the developing chamber to thereby squeeze off the liquid developer after it is contacted with the photosensitive surface;

a pressing plate is provided to press the electrophotographic material against said mouth of the framed opening during the developing process of applying the liquid developer and during the squeezing process of applying the gas to remove the liquid developer, said pressing slate being released when the electrophotographic material is advanced to the next frame of electrophotosensitive material; and a pressure reduction means is provided to apply a negative pressure to a space between the photosensitive surface and at least a portion of the mouth of the framed opening of the developing mask means.

2. A developing head for an electrophotographic apparatus as claimed in claim 1 wherein said negative pressure is applied to a space between the lower end of the mouth of the framed opening and the lower end of the photosensitive surface.

3. A developing head for an electrophotographic apparatus as claimed in claim 1 wherein said pressure reduction means is a suction pump.

4. In a developing head for an electrophotographic apparatus which comprises a developing mask means having a developing chamber defined by a framed opening facing a photosensitive surface of an electrophotographic material for electrophotography, a mouth of said opening abutting said photosensitive surface and an outer peripheral surface of said developing mask means opposing the photosensitive surface and wherein the photosensitive surface is contacted with a liquid developer supplied from a liquid feeding means via said developing chamber to achieve development of the electrophotographic material, the improvement wherein:

a gas applying means is provided to apply gas onto the photosensitive surface via the developing chamber to thereby squeeze off the liquid developer after it is contacted with the photosensitive surface;

a first passageway is provided exclusively for supplying the liquid developer;

a second passageway is provided exclusively for supplying the gas;

a valve is provided to close said second passageway when the liquid developer is fed;

a pressing plate is provided to abut the back of the electrophotographic material againt the mouth of the framed opening as said material passes the same when the liquid developer is applied for developing and when the gas is applied to squeeze off the residual liquid developer and to release pressing when the electrophotographic material is advanced to the next frame of electrophotosensitive material; and a pressure reduction means is provided to apply a negative pressure to a space between the photosensitive surface and at least a portion of the mouth of the framed opening of the developing mask means.

5. In a developing head for an electrophotographic apparatus which comprises a developing mask means having a developing chamber defined by a framed opening facing a photosensitive surface of an electrophotographic material for electrophotography, a mouth of said opening abutting said photosensitive surface and an outer peripheral surface of said developing mask means opposing the photosensitive surface and wherein the photosensitive surface is contacted with a liquid developer supplied from a liquid feeding means via said developing chamber to achieve development of the electrophotographic material, the improvement wherein:

a bent or curved portion is formed near the mouth of the framed opening of the developing mask means to form an angle greater than that formed between the rest of the outer peripheral surface of the developing mask means with said electrophotographic material thereby forming a space to prevent the liquid developer from leaking through said bent portion and the electrophotographic material by capillarity;

a gas applying means is provided to apply gas onto the photosensitive surface via the developing chamber to thereby squeeze off the liquid developer after it is contacted with the photosensitive surface;

a pressing plate is provided to abut the back of the electrophotographic material against the mouth of the framed opening for the developing mask means as said material passes the same when the liquid developer is applied for developing and when the gas is applied to squeeze off the residual liquid developer and to release pressing when the electrophotographic material is advanced to the next frame of electrophotosensitive material; and a pressure reduction means is provided to apply a negative pressure to a space between the photosensitive surface and at least a portion of the mouth of the framed opening of the developing mask means.

6. In a developing head for an electrophotographic apparatus which comprises a developing mask means having a developing chamber defined by a framed opening facing a photosensitive surface of an electrophotographic material for electrophotography, a mouth of said opening abutting said photosensitive surface and an outer peripheral surface of said developing mask means opposing the photosensitive surface and wherein the photosensitive surface is contacted with a liquid developer supplied from a liquid feeding means via said developing chamber to achieve development of the electrophotographic material, the improvement wherein:

a bent or curved portion is formed near the mouth of the framed opening of the developing mask means to form an angle greater than that formed between the rest of the outer peripheral surface of the developing mask means with said electrophotographic material thereby forming a space to prevent the liquid developer from leaking through said bent portion and the electrophotographic material by capillarity;

a gas applying means is provided to apply gas onto the photosensitive surface via the developing chamber to thereby squeeze off the liquid developer after it is contacted with the photosensitive surface;

a first passageway is provided exclusively for supplying the liquid developer;

a second passageway is provided exclusively for supplying the gas;

a valve is provided to close said second passageway when the liquid developer is supplied;

a pressing plate is provided to abut the back of the electrophotographic material against the mouth of the framed opening of the developing mask means as said material passes the same when the liquid developer is applied for developing and when the gas is applied to squeeze off the residual liquid developer and to release pressing when the electrophotographic material is advanced to the next frame of electrophotosensitive material; and a pressure reduction means is provided to apply a negative pressure to a space between the photosensitive surface and at least a portion of the mouth of the framed opening for the developing mask means.

7. The developing head for an electrophotographic apparatus as claimed in claim 6 wherein said space comprises an annular groove formed on the outer peripheral surface of said developing head near said mouth to profile the contour of the framed opening.

8. The developing head as claimed in claim 6 wherein said valve is located at the junction of a third passageway which communicates with the first and the second passageways of the developing chamber thereby causing the liquid developer and the gas to flow alternately.

9. The developing head as claimed in claim 6 wherein said valve is located in the second passageway.

10. The developing head as claimed in claim 6 wherein the negative pressure is applied to the space between the lower end of the mouth of the framed opening and the lower end of the photosensitive surface.

11. The developing head for an electrophotographic apparatus as claimed in claim 6 wherein said pressure reduction means is a suction pump.

12. The developing head for an electrophotographic apparatus as claimed in any one of claims 1, 4, 5 or 6 wherein said electrophotographic material is pressed against said mouth of the framed opening of the developing mask means by said pressing plate so as to reduce the interstice between said mouth of the framed opening of the developing mask means and said electrophotographic material to 25 μm or less.

13. A developing head according to any of claims 1, 4, 5 or 6, wherein said liquid feeding means for said liquid developer comprises a toner tank, a liquid feeding pump and an auxiliary toner tank provided above the developing chamber.

* * * * *